US005367989A

United States Patent [19]

Peyer

[11] Patent Number: 5,367,989

[45] Date of Patent: Nov. 29, 1994

[54] VALVE SHUTTER CONTROL

[76] Inventor: Peter Peyer, 1908 Ree Ford Rd., Greenville, S.C. 29609

[21] Appl. No.: 161,352

[22] Filed: Dec. 6, 1993

[51] Int. Cl.[5] ..... F01L 5/10; F01L 5/12

[52] U.S. Cl. ..... 123/81 C; 123/188.5

[58] Field of Search ..... 123/188.5, 190.1, 190.12, 123/190.4, 80 C, 81 R, 81 C

[56] References Cited

U.S. PATENT DOCUMENTS

| | | | |
|---|---|---|---|
| 996,339 | 6/1911 | Hoiland . | |
| 1,084,977 | 1/1914 | Stevens . | |
| 1,310,667 | 7/1919 | McCollum | 123/81 C |
| 1,582,195 | 5/1926 | Vallier . | |
| 2,401,923 | 6/1946 | Heintz | 123/80 C |
| 3,948,241 | 4/1976 | Melchior | 123/80 C |
| 4,163,438 | 8/1979 | Guenther et al. | 123/80 R |
| 4,481,917 | 11/1984 | Rus et al. | 123/190.12 |
| 4,976,227 | 12/1990 | Draper | 123/190.1 |
| 5,103,780 | 5/1992 | Ishii | 123/90.15 |

*Primary Examiner*—Willis R. Wolfe
*Assistant Examiner*—Erick Solis
*Attorney, Agent, or Firm*—Gerald R. Boss; Cort Flint

[57] ABSTRACT

A valve system for controlling the opening and closing of the intake and exhaust ports of the internal combustion engine's cylinders consists of a shutter valve assembly which opens and closes a row of openings registering with the engine's combustion chamber. The shutter assembly includes a movable shutter ring having a plurality of shutter openings which either register with the intake ports during the intake cycle of the internal combustion engine or with the exhaust ports during the exhaust cycle of the internal combustion engine. A controller regulates the rotation of the shutter ring so that the appropriate ports are in communication with the cylinder for proper intake of fluid and air and the exhaust of fumes from the combustion. An engine management computer determines the precise opening and closing time of the intake and exhaust ports and initiates an electrical signal for commanding the controller to move the shutter ring to the appropriate position, thereby either closing or opening the intake and exhaust ports.

20 Claims, 5 Drawing Sheets

VALVE SHUTTER CONTROL

BACKGROUND OF THE INVENTION

The invention relates to a valve system in general, and in particular, to a valve shutter system for the control of fuel/air intake and exhaust dispersions from a cylinder containing a piston commonly found in an internal combustion engine. The valve shutter system includes a shutter assembly having a shutter cage including a plurality of apertures arranged along the circumference of the cylinder head and a shutter ring having corresponding apertures of similar size which rotate to align and close the shutter cage apertures for regulating the intake and exhaust cycles of the internal combustion engine.

In the standard automobile, the automobile is powered by an internal combustion engine turning a crank shaft and consequently the fly wheel. In an internal combustion engine, the combustible fuel burns inside the engine taking place within a cylinder. In the cylinder a piston, which is connected to a crank shaft through a connecting rod, oscillates up and down during its operating process. The cyclical movement of the piston moving up and down powers the crank shaft. This cyclical movement in an automobile engine is generally termed as a four stroke cycle.

The four stroke cycle in a gasoline engine includes the intake stroke, the compression stroke, the power stroke, and the exhaust. In order to maximize the conversion of heat energy from the combustion to mechanical energy of the piston turning the crank shaft, the combustion occurs inside a cylinder. The cylinder is closed during the combustion.

Accordingly, the cylinder head has an intake opening and an exhaust opening for allowing the fuel/air mixture to enter the cylinder and for exhaust to exit the cylinder. In order to maintain the cylinder in a closed condition on the firing of the combustible fluid, valves are used to open and close the intake and exhaust openings. These are accordingly the intake and exhaust valves.

The intake and exhaust valves operate at different times depending on the cycle of the engine. These valves are normally held closed by heavy springs and by compression in the cylinder. The purpose of the valve actuating mechanism is to overcome the spring pressure and open the valves at the proper time. The valve actuating mechanism includes the engine cam shaft, cam shaft borrowers (tappets), push rods, and rocker arms. The cam shaft is generally enclosed in the engine block or cylinder head. It has eccentric lobes (cams) ground on it for each valve in the engine. As the cam shaft rotates, the cam lobe moves up under the valve tappet, exhibiting an upward thrush through the tappet against the valve stem or push rod. This thrust overcomes a valve spring pressure as well as a gas pressure in the cylinder, causing the valve to open. When the lobe moves from under the tappet, the valve spring pressure reseats the valve, closing the opening.

In the intake cycle of the four strokes cycle, the intake valve is opened and the exhaust valve is closed allowing the entrance of the fuel air mixture into the cylinder. In the compression cycle of the four strokes cycle, both the intake and exhaust valves are closed. In the power cycle, both the intake and the exhaust valves are closed and a spark from the spark plug inside the cylinder head ignites the fuel air mixture powering and moving the piston downward. In the fourth stroke, the exhaust stroke, the piston is moved back upward from the crank shaft and the exhaust valve is opened and the intake valve is closed so that the piston can push out the exhaust fumes from the previous power combustion which exits the cylinder head through the exhaust manifold. The four stroke cycle is then repeated numerous times for the powering of the crank shaft.

The duration of the opening and closing of the intake and exhaust valves are fixed depending on the configuration of the cam lobe which lifts the valve tappets and accordingly opens the intake and exhaust valve. The fixed duration which the intake and exhaust valves are open is only optimal for one particular revolution per minute (rpm) of the crankshaft. This is generally set at around three thousand five hundred rpms. However the amount of the fuel/air mixture and consequently the exhaust fumes varies depending on the particular rpms that the automobile is operating. The optimal air to gas ratio is 14.7 parts air to 1 part fuel. Thus as more fuel is required at higher rpms a considerable volume of fuel and air is required to pass through the intake valve. Also, at lower rpms only a small volume of air and fuel is required to pass through the valve and with the valve required to remain open for a fixed period, the air/fuel mixture has a tendency to blow out of the cylinder back into the intake manifold. This phenomenon is known as blow back. Thus, with a pre-defined valve opening duration the intake and exhaust valves either stay open too long or not long enough depending on the rpms of the automobile.

Another problem associated with intake and exhaust valves is that they require cavity's to be established within the cylinder head creating a dimpled interior within the combustion chamber. Thus, when the spark plug emits a flame to ignite the fuel/air mixture, there exists uneven flame propagation and some of the fuel/air mixture does not combust. Furthermore, when some of the fuel/air mixture does combust, some of the heat energy is directed to the valve cavities and away from the piston. Both of these situations result in an inefficient combustion of the fuel/air mixture.

Previously, U.S. Pat. No. 5,103,780 discloses using a variable valve control which varies the duration which the intake and exhaust valves simultaneously remain open in a valve overlap condition in conjunction with a standard valve structure. U.S. Pat. No. 996,339 illustrates a valve system Which utilizes a rotating sleeve enclosed within the cylinder mechanically regulated by the crankshaft for aligning sleeve apertures with the intake and exhaust ports.

Accordingly, it is an object of the present invention to provide a valve system for opening and closing the intake and exhaust valves of an internal combustion engine that will enable the internal combustion engine to operate efficiently over a large range of RPMS;

Additionally, it is an object of the present invention to provide a simplistic intake and exhaust valve system which will require few moving parts and consequently weigh less and operate with less wear;

Furthermore, it is an object of the present invention to provide an internal combustion having the ability to have its intake and exhaust valves open at variable durations depending upon the efficient needs of the internal combustion engine;

Also, it is an object of the present invention to provide a simplistic intake and exhaust valve system which will provide for a small compact combustion chamber inside the cylinder head thus promoting a more efficient burning of the fuel/air mixture.

SUMMARY OF THE INVENTION

The above objectives are accomplished according to the present invention by providing a valve system for controlling the opening and closing of the intake and exhaust ports of the internal combustion engine's cylinders. The valve system consists of a shutter valve assembly having a plurality of intake shutter openings by which an intake flow passes through the intake port during an intake cycle and a plurality of exhaust shutter openings by which an exhaust flow passes through the exhaust port during an exhaust cycle. A moveable shutter element selectively opens and closes the shutter openings of the intake and exhaust ports. A valve actuating system reciprocates the moveable shutter element to open and close the intake ports during the intake cycle and open and close the exhaust port during the exhaust cycle. Sensors sense the engine operating conditions and generate sensor signals for proper intake of fuel and air and the exhaust of fumes from the combustion. A controller receives the sensor signals and controls the valve actuating system accordingly.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
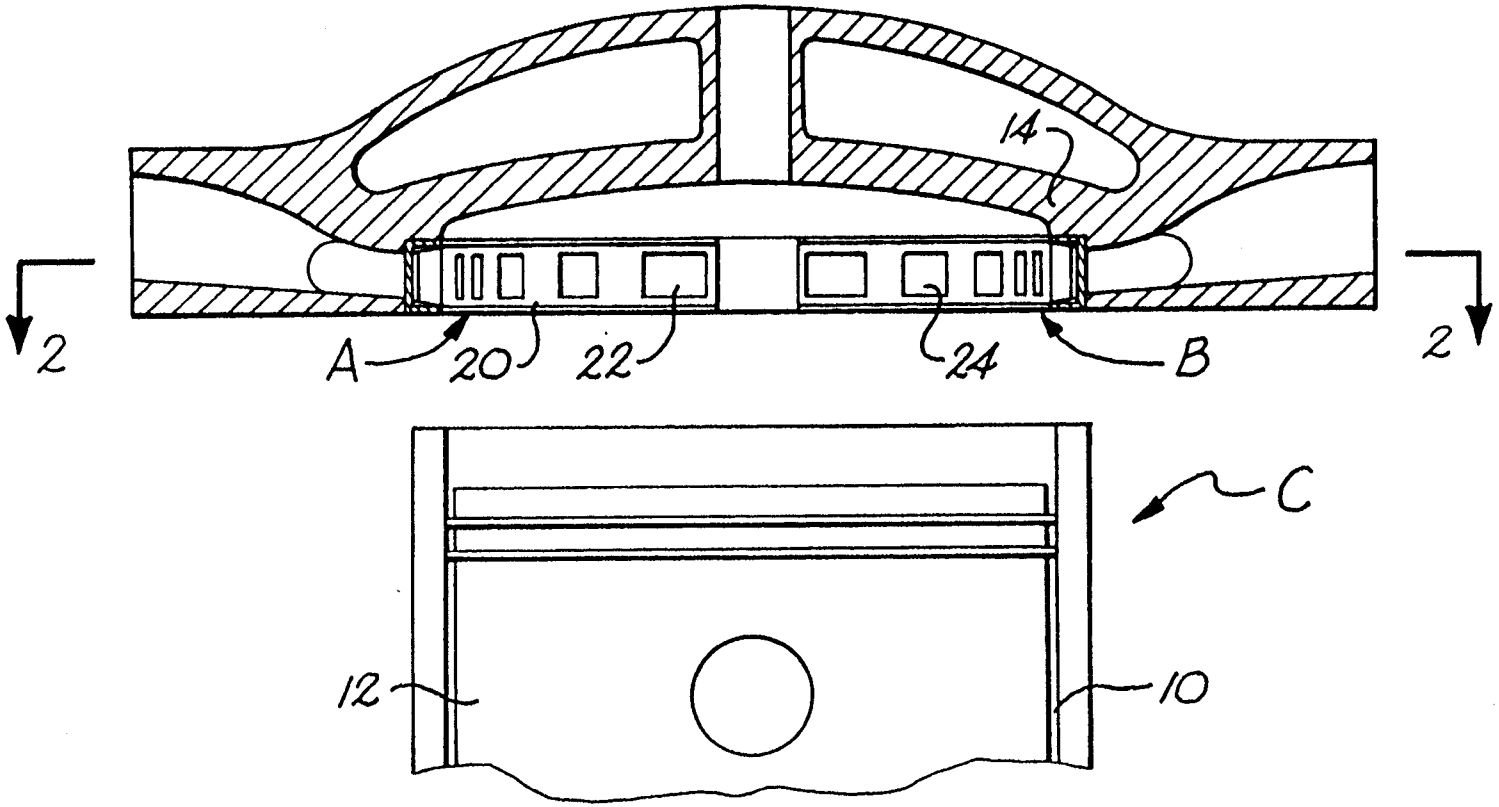
FIG. 1 is a perspective view of a valve system according to the invention.

Referring now in more detail to the drawings, a valve system is illustrated. FIGS. 1, 2, 3, 4, 5 and 6 illustrate a valve system A including a shutter valve assembly B for the control of the intake and exhaust phase of an internal combustion engine's C operating cycle. Internal combustion engine C includes a cylinder bore 10 in which a reciprocating piston 12 moves in an intake, compression, power, and exhaust cycle. A cylinder head 14 receives intake ports 16 and exhaust ports 18. Shutter valve assembly B is pressed or cast directly into cylinder head 14 thereby maintaining a proper seal and selectively opens and closes intake ports 16 and exhaust ports 18. A valve actuating system D controls the movement of shutter valve assembly B for registering and unregistering with intake ports 16 and exhaust ports 18 depending on the relevant combustion cycle. A controller E controls the operation of valve actuating system D. Controller E receives engine operation information from sensors 19 and varies the duration which shutter valve assembly B registers with intake ports 16 and exhaust ports 18 depending on certain parameters involved with the operation of internal combustion engine B.

Figure 2:
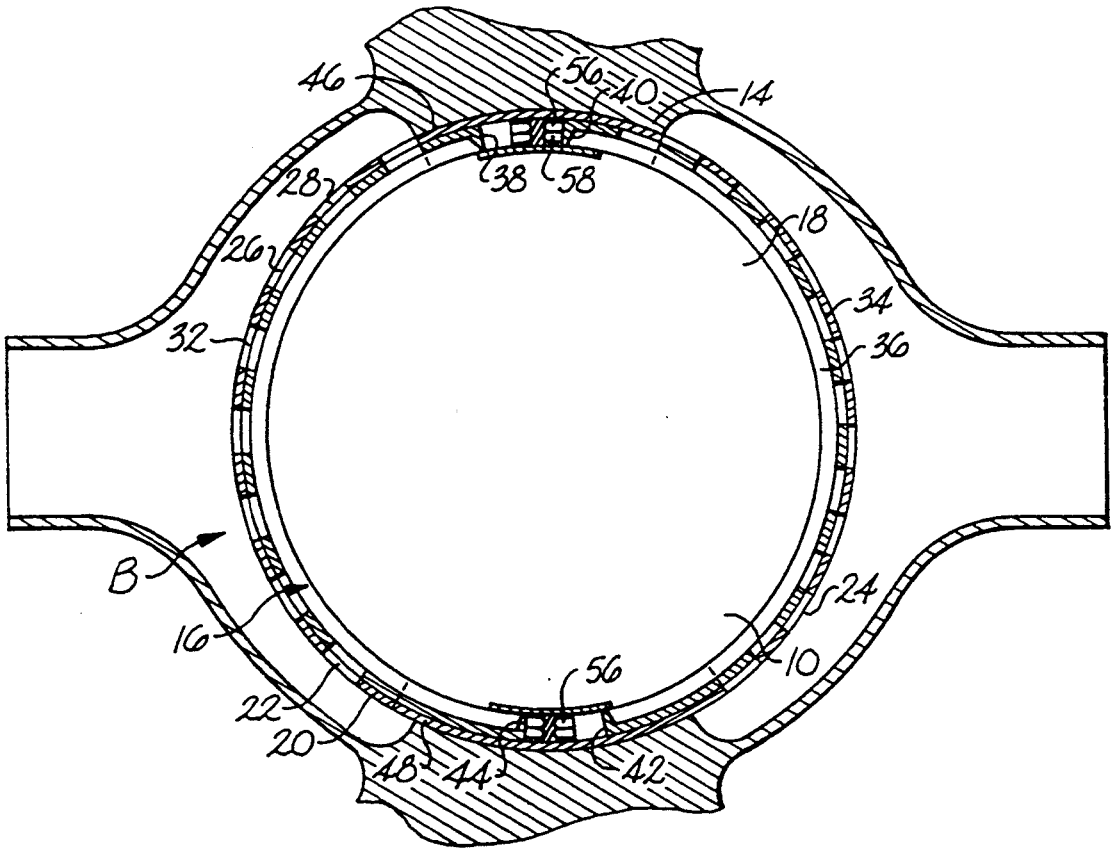
FIG. 2 is a sectional view taken along line 2—2 of FIG. 1.

As shown in FIGS. 1,2 intake ports 16 and exhaust ports 18 are located on opposing sides of cylinder head 14. Shutter valve assembly B includes an arcuate fixed shutter cage 20 having a plurality of intake shutter opening 22 and plurality of exhaust shutter openings 24 of a given size, shape and fixed distance apart. Since shutter cage 20 is fixed, openings 22 and 24 are also located at fixed locations. Intake shutter openings 22 register with intake ports 16 and exhaust shutter openings 24 register with exhaust ports 18. Shutter cage 20 is located along the circumference of cylinder head 14 inside inlet port 16 and exhaust port 18. By placing shutter valve assembly B along the circumference of cylinder head 14, cylinder head 14 remains devoid of any cavity's thus promoting an efficient burning of the fuel/air mixture. Even flame propagation is aided and more heat energy is directed towards the piston.

Figure 3:
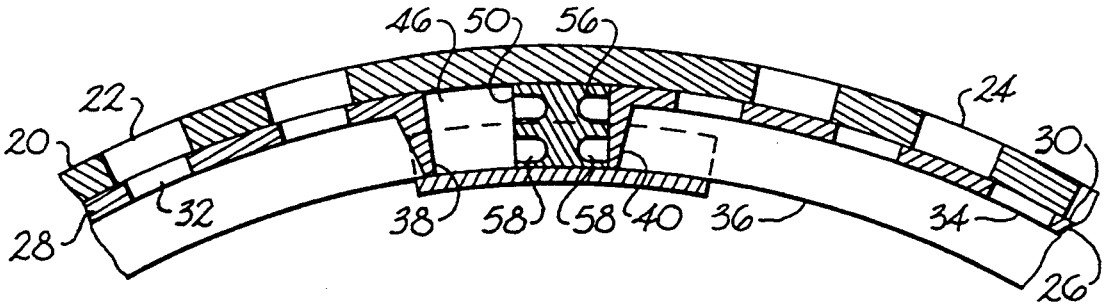
FIG. 3 is a sectional view taken along line 3—3 of FIG. 2 illustrating a valve actuating system according to the invention.

As shown in FIGS. 2 and 3 shutter cage 20 includes a moveable shutter element 26 which by reciprocating back and forth selectively opens and closes shutter openings 22 and 24 respectively. In the preferred embodiment, moveable shutter element 26 is comprised of a moveable intake shutter ring 28 and a moveable exhaust shutter ring 30. Shutter rings 28 and 30 are made of a carbon fiber material having a plasmic coating of ceramic or aluminum oxide which enables shutter rings 28 and 30 to operate within shutter cage 32.

Moveable intake shutter ring 28 includes an intake register 32 which includes a plurality of openings similar to intake shutter openings 22. By the reciprocation of moveable intake shutter ring 28, intake registers 32 register and unregister with intake shutter openings 22 thereby opening and closing intake shutter openings 22. Intake registers 32 open intake shutter openings 22 during the intake cycle enabling an intake flow to pass through intake port 16 and close intake shutter openings 22 during the compression, power and exhaust cycles. Moveable exhaust shutter ring 30 includes exhaust registers 34 which includes a plurality of openings similar to exhaust shutter openings 24. By the reciprocation of moveable exhaust shutter ring 30, exhaust registers 34 register and unregister with exhaust shutter openings 24 thereby opening and closing exhaust shutter openings 24. Exhaust registers 34 open exhaust shutter openings 24 during the exhaust cycle enabling exhaust to flow through exhaust port 18 and close exhaust shutter openings 24 during the intake, compression, and power cycles. In the preferred embodiment a moveable shutter element exists for each intake port and exhaust port. The shutter opening of a shutter cage and its respective register are tapered thereby providing for an aerodynamic flow of the intake and exhaust. Shutter cage 20 has a top and a bottom which extend past the shutter rings thereby creating a hollow back 36. Pressure from the cylinder presses shutter rings 28 and 30 against the respective shutter cage 20 thereby providing for a closed seal of the cylinder chamber.

Valve actuating system D moves intake and exhaust shutter rings 28, 30. Shutter rings 28 and 30 each have a first pressure actuation face 38 located on a first end 40 and a second pressure actuation face 42 located on a second end 44. Valve actuating system D includes a first pressure chamber 46 and a second pressure chamber 48. Pressure chambers 46 and 48 each have a pressure chamber wall 50. Each shutter ring 28, 30 has a first pressure chamber 46 and a second pressure chamber 48 located at their respective ends. Valve actuating system D includes a fluid actuator 52 applying a fluid 54 to respective pressure chambers for moving intake shutter ring 28 and exhaust shutter ring 30. First pressure chamber 48 and second pressure chamber 50 both include an inlet port 56 for receiving fluid 54 into the respective chamber, and a bleed off port 58 which enables said fluid to be dispersed from the respective pressure chamber. Both inlet port 56 and bleed off port 58 have fluid feed lines (not shown).

To move shutter ring 28 or 30 in a desired opening position, valve actuating system D will allow fluid 54 to enter inlet port 56 of first pressure chamber 46 and simultaneously disperse fluid located in an opposite second pressure chamber 48 through bleed off port 58. Depending on the engine's cycle this movement may open either intake shutter openings 22 or exhaust shutter openings 24.

As shown in FIGS. 2,3 to close off intake shutter openings 22 or exhaust shutter openings 24, fluid 54 will enter second pressure chamber 48 through inlet port 46 while simultaneous pressure is dispersed from an opposite first pressure chamber 48. Thus, shutter rings 28 and 30 will move so that intake register 32 and exhaust register 34 are not aligned with intake shutter openings 22 or exhaust shutter openings 25. Ideally, the movement of shutter rings 28 and 30 is equal to the distance which plurality of intake shutter openings 22 and exhaust shutter openings 24 are spaced apart thereby preventing some openings of intake register 32 and exhaust register 34 from aligning with intake shutter openings 22 and exhaust shutter openings 24. Shutter rings 28 and 30 are of a sufficient length such that both ends always remain within first and second pressure chambers 46 and 48 thereby maintaining a pressured system. The shutters are maintained in either an open or closed position as long as fluid 54 is present in one of the pressure chambers and removed from an opposite pressure chamber.

Fluid 54 can either be hydraulic fluid or air. Both of these fluids have certain advantages. It is important for shutter rings 28 and 30 to align with a specific reference point located in pressure chambers 46 and 48, thereby enabling valve actuating system D to continuously align intake register 32 with intake shutter openings 22 and exhaust register 34 with exhaust shutter openings 24. When fluid 54 is entered into first pressure chamber 46, pressure is exerted on first pressure actuation face 38, consequently moving shutter rings 28 and 30. The movement of shutter rings 28 and 30 is ceased when second pressure actuation face 42 engages pressure chamber wall 50 of second pressure chamber 48. Shutter rings 28 and 30 are of the appropriate length such that when second pressure actuation face 42 engages pressure chamber wall 50, intake register 32 registers with intake shutter openings 22 and exhaust register 34 registers with exhaust shutter openings 24. This procedure is duplicated by first pressure actuation face 40 when intake shutter openings 22 and exhaust shutter openings 24 are closed. As shown in FIG. 2, intake shutter ring 28 has moved to align intake registers 32 with intake shutter openings 22 allowing intake to enter cylinder bore 10. Also, exhaust shutter ring 30 has moved to unregister exhaust registers 34 with exhaust shutter openings 24 thereby closing exhaust port 18.

Figure 5:
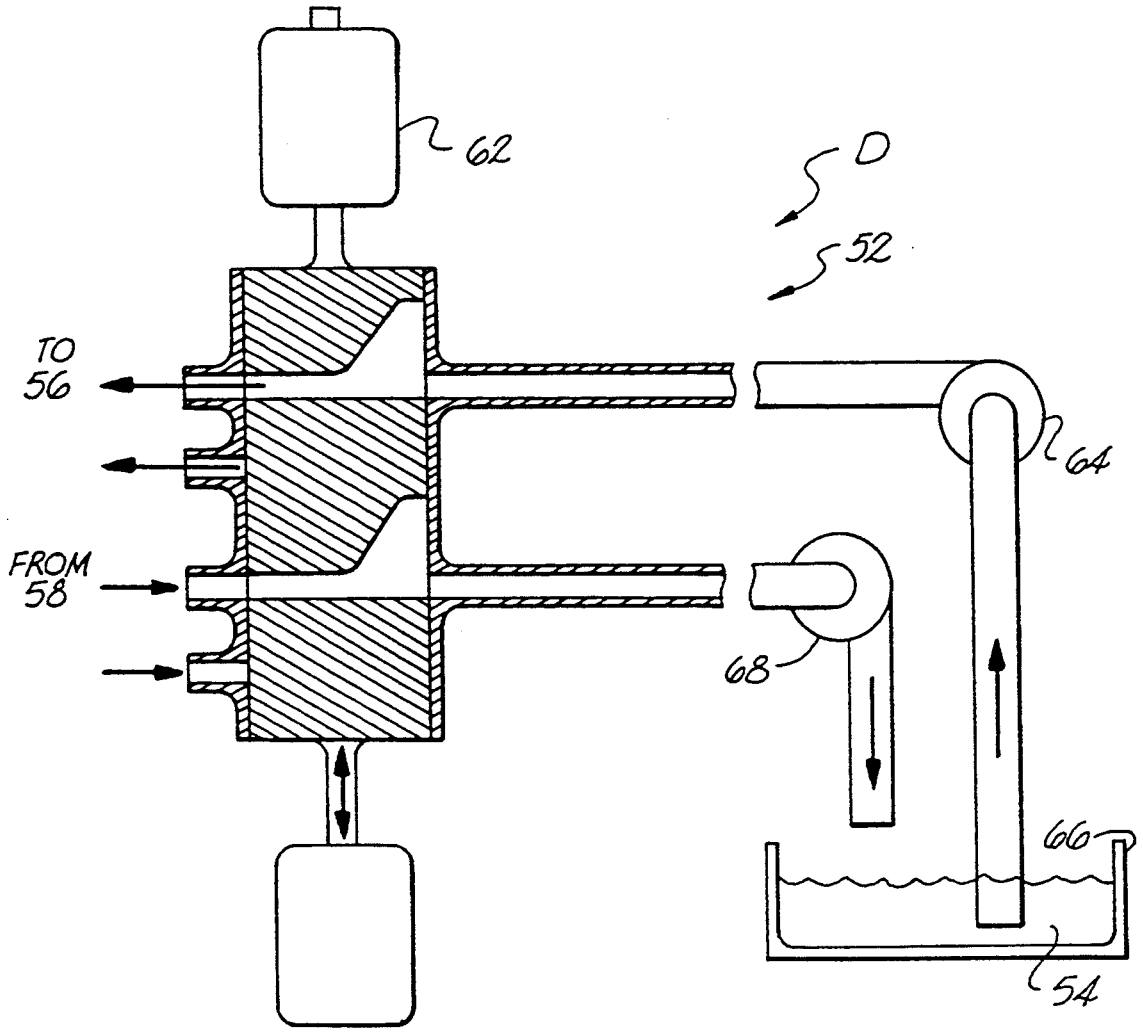
FIG. 5 illustrates a valve actuating system utilizing hydraulic fluid according to one embodiment of the invention.
Figure 6:
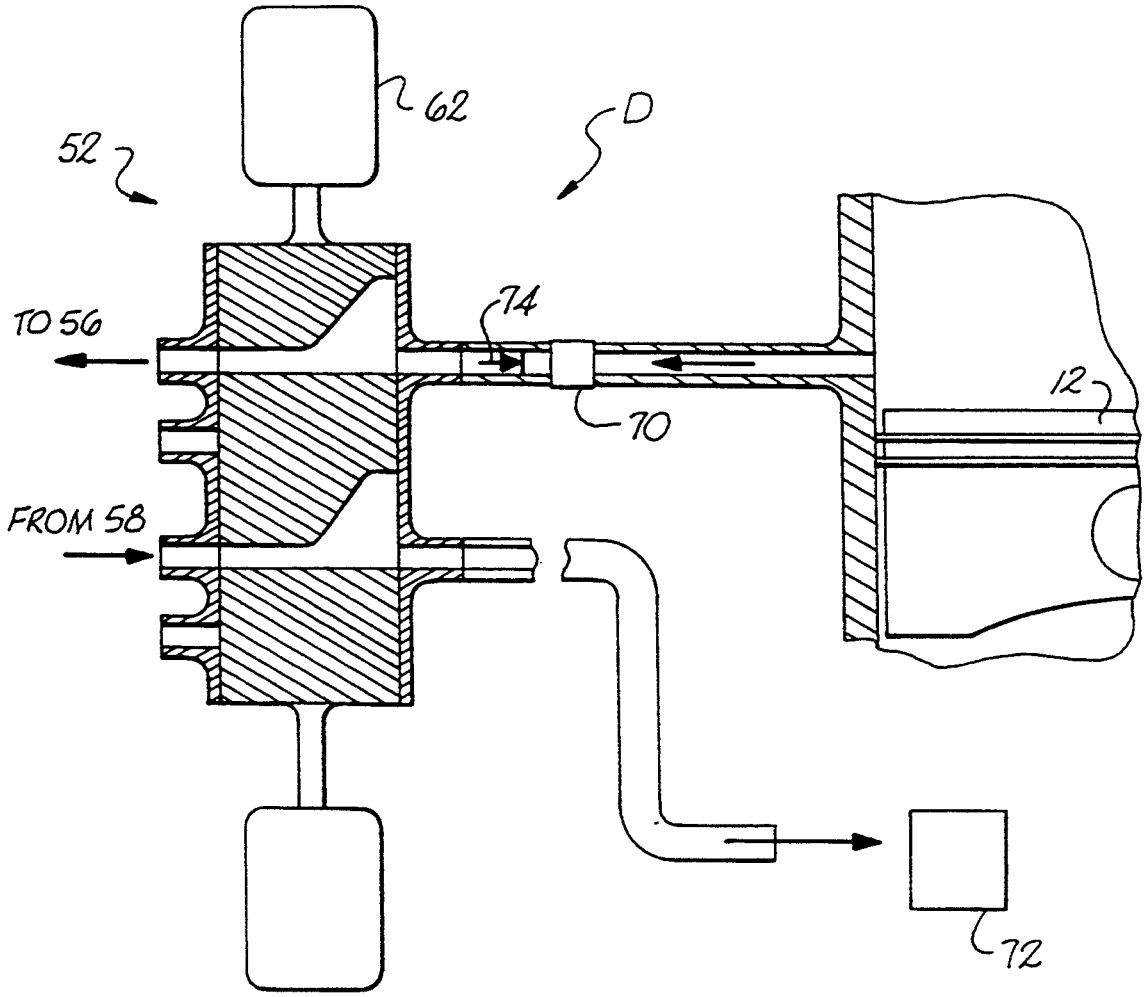
FIG. 6 illustrates a valve actuating system utilizing air according to one embodiment of the invention.

As shown in FIGS. 5 and 6, fluid actuator 52 may be a two stage two way solenoid valve 62. As shown in FIG. 5, the two way valve is connected by feed lines to the respective pressure chambers. As shown in FIG. 5, if fluid 54 is hydraulic fluid, there exists a hydraulic pump 64 for directing fluid from a fluid basin 66 and a vacuum pump 68 for returning dispersed fluid to fluid basin 66. Furthermore, the pump is an electric pump and is dedicated to this system. Accordingly, when the ignition is turned on at the initial starting of the engine, this pump will be activated to send fluid to the appropriate shutter rings.

As shown in FIG. 6, if fluid 54 is air, the pressure system utilizes pressure bladder 70 for maintaining pressure within the system. Pressure from the cylinder charges the pressure system directing air through solenoid valve 62 to a selected port. Also, a vacuum from intake manifold 72 removes pressure from a second respective pressure chamber. A one-way valve 74 maintains pressure in the system. The vacuum from the intake manifold is used because a vacuum always exist in the operation of the automobile's engine. Fluid 54 will always be present in one of the pressure chambers depending on the last rotation of the shutter.

Figure 4:
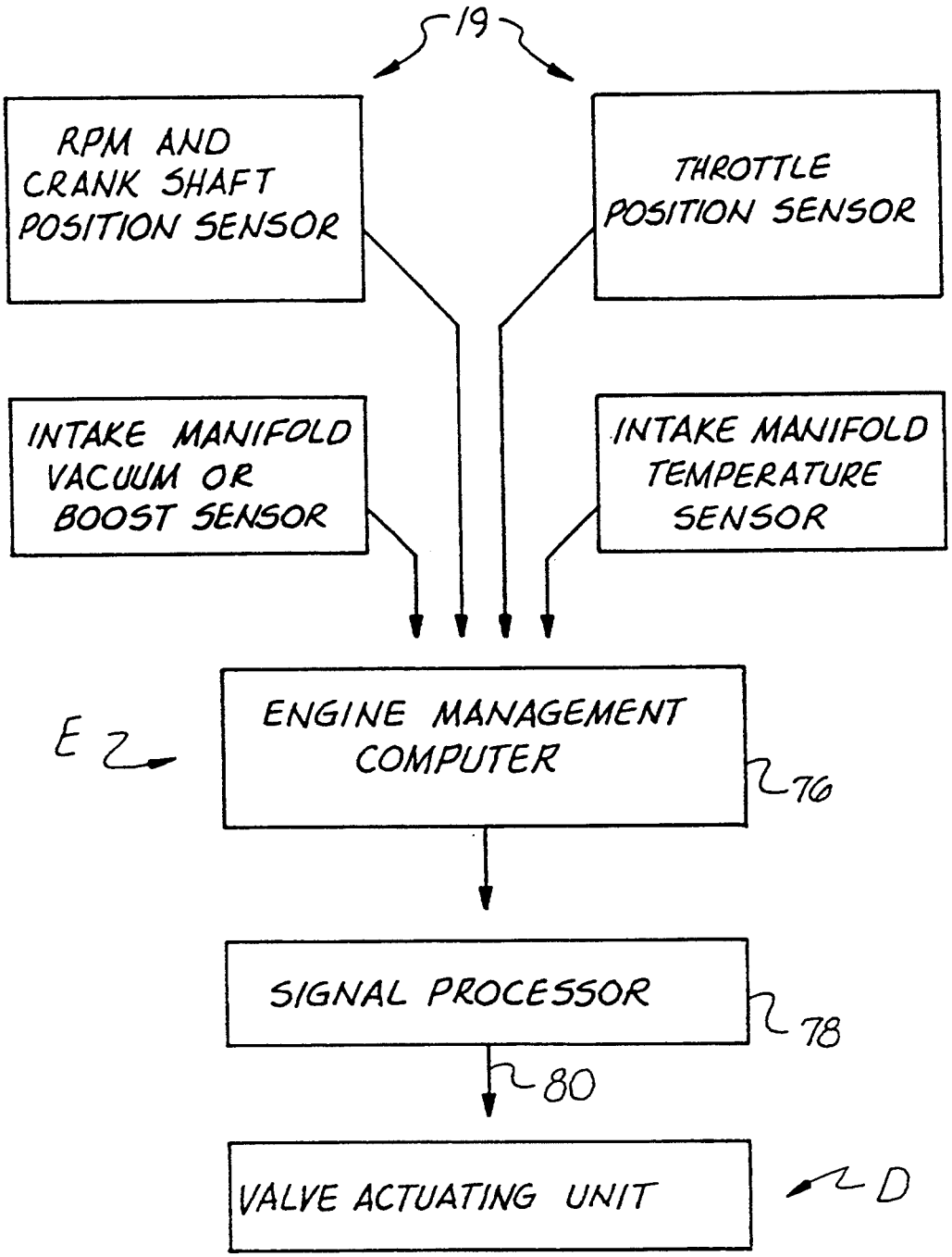
FIG. 4 is a schematic of a valve system according to the invention.

As shown in FIG. 4, fluid actuator 52 is controlled by controller E for positioning intake registers 32 and exhaust registers 34 for variable durations. In this variable manner, intake ports 16 and exhaust ports 18 are opened for a sufficient amount of time enabling the cylinder to receive the fuel/air mixture for the desired rpm and to disperse the resulting exhaust. Controller E is comprised of sensors 19, an engine management computer 76 and a signal processor 78. Engine management computer 76 receives engine parameters from sensors 19 sensing the operations of the engine. Sensors 19 measure the engines RPM and crank shaft position; throttle opening position; the intake manifold vacuum or boost; and the intake manifold temperature. Based upon these parameters engine management computer 76 will determine the precise opening and closing time of intake shutter openings 22 and exhaust shutter openings 24. The sensors required by engine management computer 76 are currently known in the art. The crank shaft sensor for instance is currently used for fuel injection and ignition timing.

Due to the weakness of the signals generated from the engine management computer 76, signal processor 78 is utilized to create an electrical signal of sufficient capacity to operate valve actuating unit D. In order to enable valve actuating unit D to operate fluid actuator 52 for variable durations, signal processor 78 will generate signals 80 of different durations as directed by the engine management computer 76. The engine management computer 76 will direct the signal processor to direct a signal to the operate the pressure chamber for moving shutter rings 28 and 30 for opening and closing intake and exhaust ports 16 and 18 as necessary during the four cycles of the engine.

Therefore, it can be seen that a more advantageous valve system for a internal combustion system may be had according to the invention. The carrying of the shutter cage by the cylinder head removes any cavities currently existing in current internal combustion engines which utilize piston like valve. These cavities currently reduce the efficiency of the combustion engine by prohibiting the transfer of some heat energy towards the pistons- Accordingly, the shutter valve assembly made according to the invention provides for a smooth interior of the cylinder devoid of any cavities. Such a structure enables all of the power generated from the combustion to be directed towards the piston resulting in a more efficient fuel system. Furthermore, a compact combustion chamber in the cylinder head enables flame propagation from the spark plug to be entirely directed to the fuel mixture thereby creating for a more efficient engine.

Also this system enables the intake and exhaust ports to register with the cylinder for variable times. By including openings all along the circumference of the cylinder, a greater flow area is created to enable intake and exhaust to enter and exit the cylinder. Additionally, with the variable systems, the openings may be opened for a longer duration at higher RPMs allowing more fuel to be admitted into the cylinder and also at a shorter duration at low RPMs when only a small amount of fuel is transmitted to the cylinder and preventing back blow. Thus consequently with a small opening time at low RPMs all of the fuel is retained in the cylinder. Furthermore by having more shutter openings, the cylinder head may be a reduced size thus creating a more compact combustion chamber head.

While a preferred embodiment of the invention has been described using specific terms, such description is for illustrative purposes only, and it is to be understood that changes and variations may be made without departing from the spirit or scope of the following claims.

What is claimed is:

1. A valve system for controlling the intake port and exhaust port of an internal combustion engine having a cylinder in which a reciprocating piston moves in an intake, compression, power, and exhaust cycle, a cylinder head in which said intake port and exhaust port are found, wherein said valve system comprises:

a shutter valve assembly having a plurality of intake shutter openings by which an intake flow passes through said intake port during said intake cycle, and said shutter valve assembly having a plurality of exhaust shutter openings by which an exhaust flow passes through said exhaust port during said exhaust cycle;

said shutter valve assembly having a first moveable shutter element which selectively opens and closes said shutter openings of said intake port and a second moveable shutter element which selectively opens and closes said shutter openings of said exhaust port;

said first and second moveable shutter elements being independent of each other;

a valve actuating system for reciprocating said first moveable shutter element to open and close said intake port during said intake cycle and for reciprocating said second moveable shutter element to open and close said exhaust port during said exhaust cycle;

a plurality of sensors for sensing engine operating conditions and generating sensor signals for regulating the operation of said valve actuating system; and a controller responsive to said sensor signals for controlling said valve actuating system.

2. The valve system of claim 1 wherein said shutter valve assembly includes an arcuate shutter cage housing said moveable shutter element.

3. The valve system of claim 1 wherein said plurality of shutter openings of said shutter valve assembly are unaligned with said intake and exhaust ports during said compression and power cycles.

4. A valve system for controlling the intake port and exhaust port of an internal combustion engine having a cylinder in which a reciprocating piston moves in an intake, compression power, and exhaust cycle, a cylinder head in which said intake and exhaust ports are found, wherein said valve system comprises:

a shutter valve assembly having a plurality of intake shutter openings by which an intake flow passes through said intake port during said intake cycle, and said shutter valve assembly having a plurality of exhaust shutter openings by which an exhaust flow passes through said exhaust port during said exhaust cycle;

said shutter valve assembly having a moveable shutter element which selectively opens and closes said shutter openings of said intake port and exhaust port;

a valve actuating system for reciprocating said moveable shutter element to open and close said intake ports during said intake cycle and open and close said exhaust ports during said exhaust cycle;

a plurality of sensors for sensing engine operating conditions and generating sensor signals for regulating the operation of said valve actuating system; and a controller responsive to said sensor signals for controlling said valve actuating system;

said valve actuating system having a solenoid regulating the movement of said moveable shutter element in response to said controller.

5. The valve system of claim 4 wherein said controller includes an engine management computer and a signal processor, said engine management computer commanding said signal processor to generate electrical signals of varying duration thereby controlling the duration that said plurality of shutter openings are aligned with said intake ports or said exhaust ports respectively.

6. The valve system of claim 5 wherein said sensors include sensors sensing the revolutions per minute and position of the crank shaft of the internal combustion engine, the position of the throttle, the intake manifold vacuum or boost, and the intake manifold temperature;

said engine management computer receiving input from said sensors for computing the duration of said signal generated from said signal processor.

7. A valve system for controlling the intake port and exhaust port of an internal combustion engine having a cylinder in which a reciprocating piston moves in an intake, compression, power, and exhaust cycle, a cylinder head in which said intake port and exhaust port are found, wherein said valve system comprises:

a shutter valve assembly carried by said cylinder head for selectively opening and closing said intake port and exhaust port;

an arcuate shutter cage carried by said shutter valve assembly having a plurality of intake shutter openings disposed across said intake port during said intake cycle, and a plurality of exhaust shutter openings disposed across said exhaust port during said exhaust cycle;

a moveable intake shutter ring carried by said shutter cage having intake registers for opening and closing said intake shutter openings, said intake registers opening said intake shutter openings during said intake cycle, and closing said intake shutter openings during said compression, power, and exhaust cycles;

a moveable exhaust shutter ring carried by said shutter cage having exhaust registers for opening and closing said exhaust shutter openings, said exhaust registers opening said exhaust shutter openings during said exhaust cycle, and closing said exhaust shutter openings during said intake, compression, and power cycles;

a valve actuating system for reciprocating said first and second moveable shutter rings registering said intake shutter openings with said intake port during said intake cycle, and registering said exhaust shutter openings with said exhaust port during said exhaust cycle;

a controller for controlling said valve actuating system in response to engine operating conditions.

8. The valve system of claim 7 wherein said controller includes an engine management computer and sensors, said engine management computer receiving input from said sensors for controlling said valve actuating system.

9. The valve system of claim 8 wherein said sensors include sensors sensing the revolutions per minute and position of the crank shaft of the internal combustion engine, the position of the throttle, the intake manifold vacuum or boost, and the intake manifold temperature.

10. The valve system of claim 8 including a signal processor, said engine management computer commanding said signal processor to generate electrical signals of varying duration thereby controlling the duration that said plurality of shutter openings are aligned with said intake port or said exhaust port respectively.

11. The valve system of claim 7 wherein said intake and exhaust shutter rings respectively have a first face on one end and a second face on a second end.

12. The valve system of claim 11 wherein said shutter valve assembly comprising first and second pressure chambers at said first and second ends of said intake and exhaust shutter rings respectively which communicate with said first and second faces for selectively moving a respective one of either said intake or exhaust shutter ring in a first or second direction thereby either opening or closing the respective intake or exhaust shutter openings.

13. The valve system of claim 12 wherein said valve actuating system includes a fluid actuator for applying a fluid to said pressure chambers for acting upon said first and second faces of a respective one of said intake or exhaust shutter ring.

14. The valve system of claim 13 wherein said pressure chambers include an inlet port for receiving said fluid and a bleed off port for dispersing said fluid.

15. The valve system of claim 14 wherein said fluid is hydraulic fluid.

16. The valve system of claim 14 wherein said fluid is air.

17. The valve system of claim 7 wherein said intake registers and said exhaust registers are apertures.

18. A valve system for controlling the intake port and exhaust port of an internal combustion engine having a cylinder in which a reciprocating piston moves in an intake, compression, power, and exhaust cycle, a cylinder head in which said intake port and exhaust port are found, wherein said valve system comprises:

a shutter valve assembly carried by said cylinder head for selectively opening and closing said intake and exhaust ports;

a shutter cage carried by said shutter valve assembly having a plurality of intake shutter openings disposed across said intake port during said intake cycle, and a plurality of exhaust shutter openings disposed across said exhaust port during said exhaust cycle;

an intake reciprocating register having a first and second pressure actuation face for opening and closing said intake shutter openings;

an exhaust reciprocating register having a first and second pressure actuation face for opening and closing said exhaust shutter openings;

a valve actuating system for reciprocating said intake reciprocating register and exhaust reciprocating register registering said intake shutter openings with said intake port during said intake cycle, and registering said exhaust shutter openings with said exhaust ports during said exhaust cycle;

at least one first pressure chamber enclosing said first pressure actuation face of said intake reciprocating register and exhaust reciprocating register;

at least one second pressure chamber enclosing said second pressure actuation face of said intake reciprocating register and exhaust reciprocating register;

a fluid actuator for applying a fluid to said pressure chambers for acting upon said first and second pressure actuation faces of said intake reciprocating register and said exhaust reciprocating register;

said pressure chambers respectively including an inlet port for receiving said fluid and a bleed off port for dispersing said fluid from said chambers; wherein said inlet port of a first pressure chamber is activated by said fluid actuator to receive said fluid and said bleed off port of a second pressure chamber is simultaneously activated by said fluid actuator to disperse said fluid; and a controller for controlling said valve actuating system in response to engine operating conditions.

19. The valve assembly of claim 18 wherein said inlet port of a first pressure chamber of a respective reciprocating register is activated by said fluid actuator to receive said fluid and said bleed off port of a second pressure chamber of the respective reciprocating register is simultaneously activated by said fluid actuator to disperse said fluid.

20. The valve system of claim 18 wherein said controller includes an engine management computer and sensors, said engine management computer receiving input from said sensors for computing the duration of an electrical signal operating said fluid actuator.

* * * * *